US007621781B2

(12) United States Patent
Rothermel et al.

(10) Patent No.: US 7,621,781 B2
(45) Date of Patent: Nov. 24, 2009

(54) ELECTRICAL CONNECTOR WITH CROSSTALK CANCELING FEATURES

(75) Inventors: Brent Ryan Rothermel, Harrisburg, PA (US); Chad William Morgan, Mechanicsburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/726,346

(22) Filed: Mar. 20, 2007

(65) Prior Publication Data

US 2008/0233806 A1 Sep. 25, 2008

(51) Int. Cl.
*H01R 13/648* (2006.01)

(52) U.S. Cl. ..... 439/608; 439/941

(58) Field of Classification Search ..... 439/608, 439/607, 333, 101, 941
See application file for complete search history.

(56) References Cited

U.S. PATENT DOCUMENTS 5,224,867 A * 7/1993 Ohtsuki et al. ..... 439/108
6,976,886 B2 * 12/2005 Winings et al. ..... 439/701
2006/0024984 A1 2/2006 Cohen
2006/0068641 A1 * 3/2006 Hull et al. ..... 439/608
2007/0059961 A1 3/2007 Cartier
2007/0149057 A1 * 6/2007 Cohen et al. ..... 439/608
2008/0207023 A1 * 8/2008 Tuin et al. ..... 439/95
2008/0248693 A1 * 10/2008 Winings et al. ..... 439/608

FOREIGN PATENT DOCUMENTS

EP 1 783 871 A1 5/2007
WO WO 2008/106096 A1 9/2008

OTHER PUBLICATIONS

International Search Report, International Application No. PCT/US2008/003411, International Filing Date Mar. 14, 2008.

* cited by examiner

*Primary Examiner*—Hien Vu

(57) ABSTRACT

An electrical connector system includes first and second connector assemblies. Each connector assembly includes contacts arranged in at least two differential pairs wherein one of the pairs is an aggressor pair and one of the pairs is a victim pair. A differential signal carried by the aggressor pair generates far end crosstalk on the victim pair. The contacts are arranged such that, when the first and second connector assemblies are electrically connected to each other, the far end crosstalk on the victim pair in the first connector assembly has a magnitude and a polarity, and the far end crosstalk on the victim pair in the second connector assembly has the same magnitude and an opposite polarity.

15 Claims, 10 Drawing Sheets

ELECTRICAL CONNECTOR WITH CROSSTALK CANCELING FEATURES

BACKGROUND OF THE INVENTION

The invention relates generally to electrical connectors and, more particularly, to far end crosstalk reduction in electrical connectors.

Some electrical systems, such as network switches or a computer server with switching capability, include large backplanes with several switch cards and line cards plugged into the backplane. When cards are plugged into both sides of a circuit board, the circuit board is called a midplane. Generally, the line cards bring data from external sources into the system. The switch cards contain circuitry that may switch data from one line card to another. Traces in the backplane interconnect the line cards and the appropriate switch cards.

Some signal loss is inherent in a trace through printed circuit board material. As the number of card connections increases, more traces are required in the backplane. The increased number of traces and the length of the traces in the backplane introduce more and more signal loss in the backplane, particularly at higher signal speeds. Signal loss problems may be addressed by keeping traces in the backplane as short as possible. Connectors are sometimes oriented orthogonally on both sides of a midplane. With orthogonal connectors, the number and lengths of traces in the midplane may be reduced, thereby reducing trace losses in the midplane. Moreover, when connectors connect directly through the midplane, there are no traces.

Typically, some amount of crosstalk is present in electrical connectors, including orthogonal connectors. When multiple signals are carried through a connector, such as a connector carrying multiple pairs of differential signals, crosstalk coupling may occur in adjacent signal lines. If the coupled energy is sufficient, bit errors may be generated in an adjacent signal line. Crosstalk propagates in both directions in the adjacent lines. Near end crosstalk refers to crosstalk that propagates in the direction opposite to that of the aggressor signal, or the signal generating the crosstalk. Far end crosstalk refers to crosstalk that propagates in the same direction as the aggressor signal. Far end crosstalk is additive. That is, far end noise builds upon itself, or is cumulative. In some applications, because of its additive quality, far end crosstalk tends to be the most troublesome.

While non-orthogonal connectors have been developed that include some amount of noise cancellation, noise cancellation, or more specifically, far end crosstalk cancellation in orthogonal connector systems remains a challenge.

BRIEF DESCRIPTION OF THE INVENTION

In one aspect, an electrical connector system is provided. The connector system includes first and second connector assemblies. Each connector assembly includes contacts arranged in at least two differential pairs wherein one of the pairs is an aggressor pair and one of the pairs is a victim pair. A differential signal carried by the aggressor pair generates far end crosstalk on the victim pair. The contacts are arranged such that, when the first and second connector assemblies are electrically connected to each other, the far end crosstalk on the victim pair in the first connector assembly has a magnitude and a polarity, and the far end crosstalk on the victim pair in the second connector assembly has the same magnitude and an opposite polarity.

More specifically, the contacts include mating ends and mounting ends and each of the differential contact pairs is arranged along a centerline of a contact row. One of the differential contact pair comprises straight contacts and the other of the differential contact pair comprises offset contacts. The mounting ends of the offset contact pair are offset on opposite sides of the centerline of the row that includes the offset contact pair. Each offset contact includes a mid-section formed with the mating end. The mating end and the mid-section lie in a plane. The, offset contact includes a plate that extends from the mid-section at an angle of about forty-five degrees with respect to the plane. The housing includes a base having signal contact cavities. At least one of the signal contact cavities including a slot configured to receive the plate to orient the offset contact in the signal contact cavity.

In another aspect, an electrical connector is provided that includes a housing having a mating face and a mounting face. The housing holds signal contacts and ground contacts arranged in rows. Each of the signal contacts and ground contacts includes a mating end extending from the mating face of the housing and a mounting end extending from the mounting face of the housing. The signal contacts are arranged in alternating pairs of straight signal contacts and offset signal contacts, and wherein for each said row, said mounting ends of the ground contacts and the straight signal contacts are arranged along a centerline of the row and the mating ends of the offset signal contacts in each pair of offset signal contacts are offset on opposite sides of the centerline.

In yet another aspect, an orthogonal connector assembly is provided that includes a pair of connectors configured to be electrically connected to one another from opposite sides of a circuit board. The orthogonal connector assembly includes first and second connector housings, each having a mating face and a mounting face. The mounting faces are configured to be electrically connected to one another from opposite sides of the circuit board in line with one another along a longitudinal axis. The first and second connector housings are angularly offset ninety degrees about the longitudinal axis with respect to one another. Signal and ground contacts are held in the connector housings and arranged in rows. Each signal contact and ground contact includes a mating end and a mounting end. The signal contacts include pairs of straight signal contacts and offset signal contacts. Mated pairs of offset signal contacts on opposite sides of the circuit board are arranged about a common axis. The mated pairs are rotated one hundred eighty degrees with respect to one another about the axis.

DETAILED DESCRIPTION OF THE INVENTION

Figure 1:
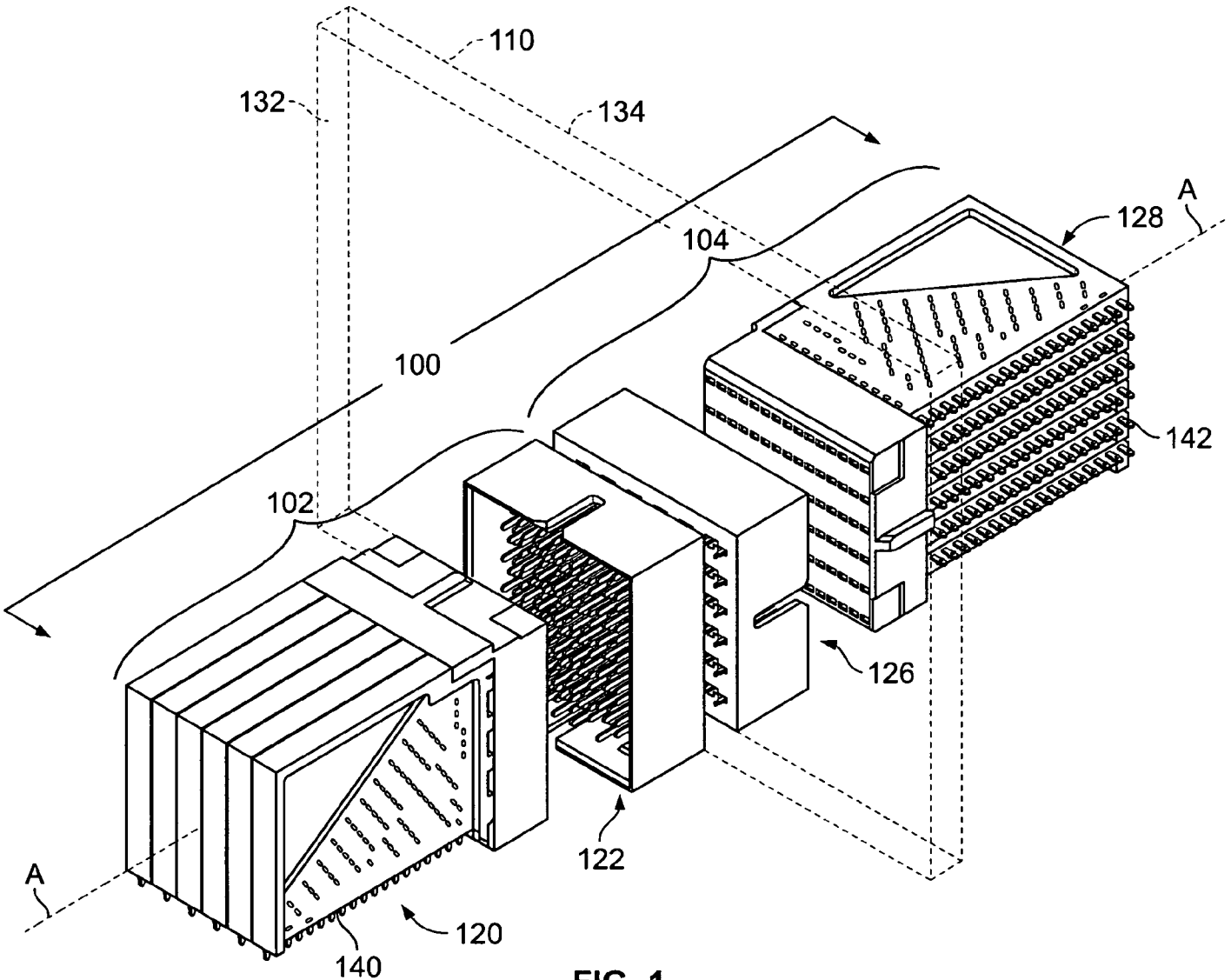
FIG. 1 is a perspective view of an orthogonal connector system formed in accordance with an exemplary embodiment of the present invention.

FIG. 1 illustrates an orthogonal connector system 100. The connector system 100 includes a first connector assembly 102 and a second connector assembly 104. The connector assemblies 102 and 104 are orthogonal connector to one another. The connector assemblies 102 and 104 are mounted on a midplane circuit board 110 which is shown in phantom lines for clarity. The first connector assembly 102 includes a first receptacle connector 120 and a first header connector 122. The second connector assembly 104 includes a second header connector 126, and a second receptacle connector 128. The first header and receptacle connectors 122 and 120, respectively, are mounted on a first side 132 of the midplane 110 and connect through the midplane 110 to the second header and receptacle connectors 126 and 128, respectively, which are mounted on a second side 134 of the midplane 110.

The first receptacle connector 120 includes a daughter card interface 140. By way of example only, the first receptacle 120 may be mounted on a line card (not shown) at the interface 140. Similarly, the second receptacle connector 128 includes a daughter card interface 142 and, by way of example only, the second receptacle 128 may be mounted on a switch card (not shown) at the interface 142. The connector system 100 includes a longitudinal axis A that extends from the first receptacle 120 through the second receptacle 128. The first and second header connectors 122 and 126, respectively, are identical to one another. The first and second receptacle connectors 120 and 128, respectively, may or may not be identical to one another.

The first and second header connectors 122 and 126 are oriented such that the first and second header connectors 122 and 126 are rotated ninety degrees with respect to one another to form the orthogonal connector system 100. The first and second receptacles 120 and 128 are likewise rotated ninety degrees with respect to one another. The orthogonal orientation of the connector system 100 facilitates the elimination of traces within the midplane and reduces signal loss through the connector system 100. The connector system 100 is also configured to cancel far end crosstalk generated in the connector system 100 in differential signals transmitted through the connector system 100, as will be described.

Although the invention will be described in terms of a connector system 100 as illustrated in FIG. 1, it is to be understood the benefits herein described are also applicable to connector systems that do not include a midplane circuit board. Due to the similarity between the first connector assembly 102 and the second connector assembly 104, only the first connector 102 will be described in detail.

Figure 2:
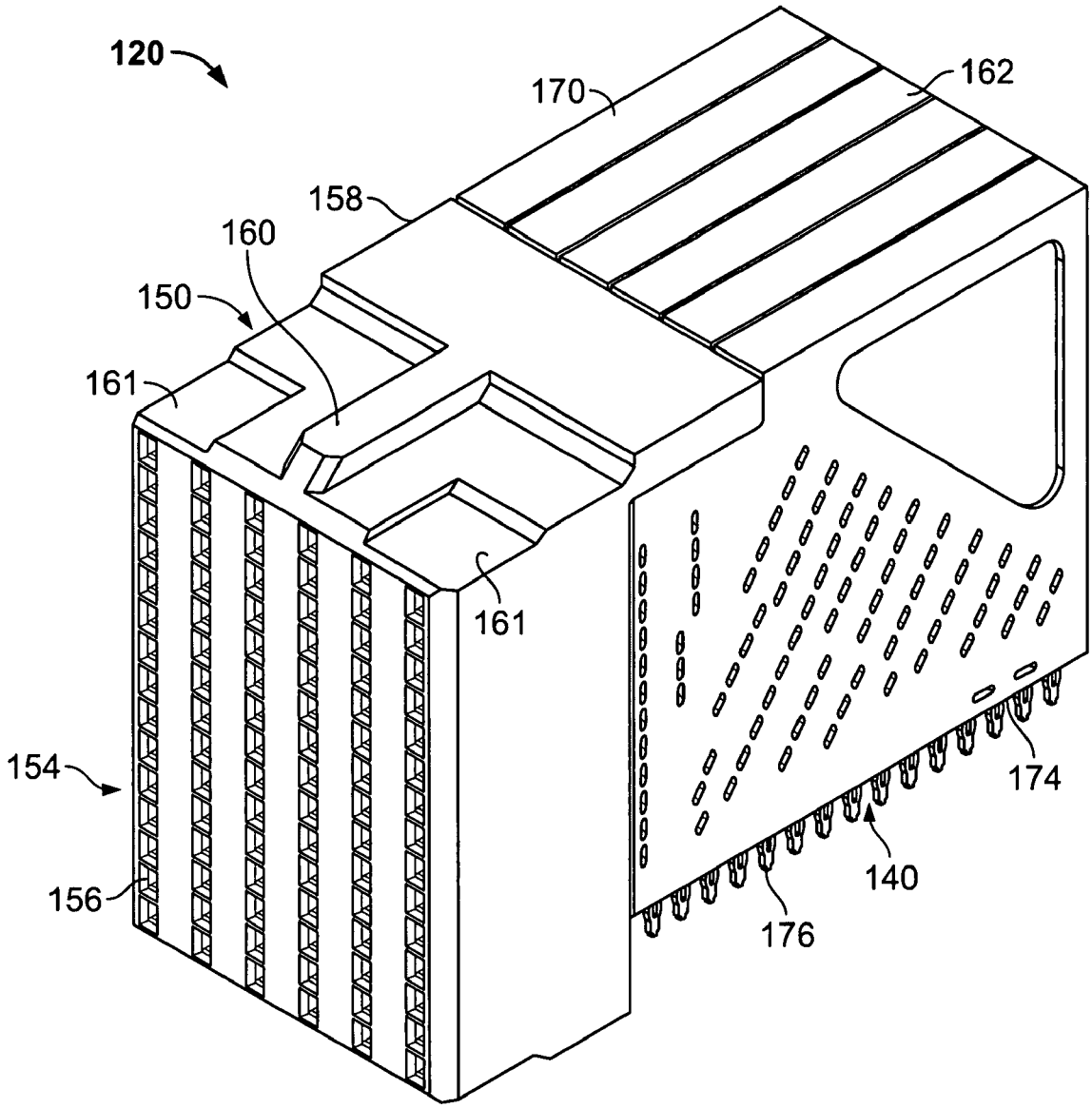
FIG. 2 is a perspective view one of the receptacle connectors shown in FIG. 1.
Figure 3:
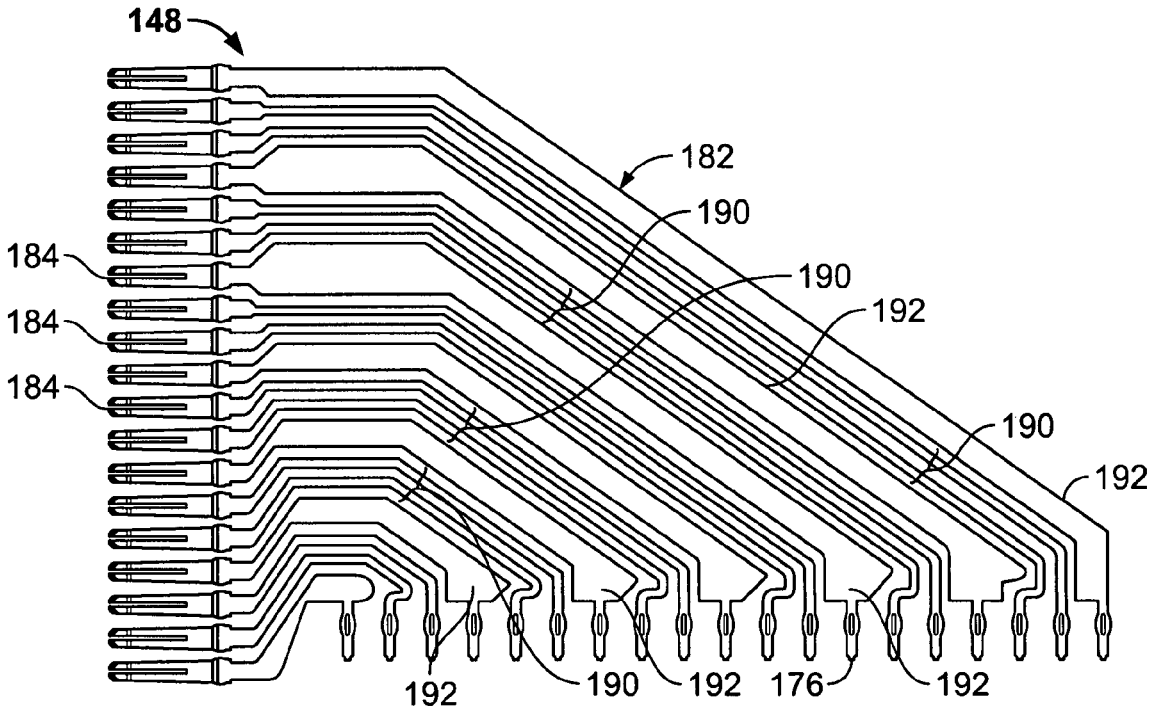
FIG. 3 is a front elevational view of a lead frame formed in accordance with an exemplary embodiment of the present invention.

FIG. 2 illustrates a perspective view of the receptacle connector 120. FIG. 3 illustrates a lead frame 148 that is contained in the receptacle connector 120. The receptacle connector 120 includes a dielectric housing 150 that has a mating face 154 having a plurality of contact channels 156. The contact channels 156 are configured to receive mating contacts 350, 352, 390 (see FIG. 8) from a mating header connector such as the header connector 122 shown in FIG. 1. The receptacle connector 120 also includes an upper shroud 158 that extends rearwardly from the mating face 154. Guide ribs 160 are formed on opposite sides of the housing 150 to orient the receptacle connector 120 for mating with the header connector 122. An alignment recess 161 is provided on each side of the guide rib 160. The housing 150 receives a plurality of contact modules or chicklets 162 holding contacts that connect the daughter card interface 140 with the mating face 154. In an exemplary embodiment, the interface 140 is substantially perpendicular to the mating face 154 such that the receptacle connector 120 interconnects electrical components that are substantially at a right angle to each other.

Each chicklet 162 includes a contact lead frame such as the lead frame 148 that is overmolded and encased in a contact module housing 170 fabricated from a dielectric material. The housing 170 has a forward mating end (not shown) that is received in the receptacle connector housing 150 and a mounting edge 174 configured for mounting to a circuit board. Contact tails 176 extend from the lead frame within the contact module 162 and extend through the mounting edge 174 of the contact module 162 for attachment to a circuit board (not shown).

The contact lead frame 148 includes a plurality of conductive leads 182 terminating at one end with a mating contact 184 and terminating at the other end with the mounting contact tails 176. The contact lead frame 148 includes pairs of signal leads 190 and individual ground leads 192 arranged in an alternating sequence wherein individual ground leads 192 separate pairs of signal leads 190 from one another. In some embodiments, the signal lead pairs 190 and ground leads 192 may be offset relative to the signal lead pairs 190 and ground leads 192 in an adjacent chicklet, although the alternating pattern is maintained. In an exemplary embodiment, the signal lead pairs 190 carry and transmit differential signals and each of the signal lead pairs 190 comprises a differential pair 190. Any of the signal lead pairs 190, when switching or transmitting a signal, has the potential to produce crosstalk in an adjacent signal lead pair 190 with the level of crosstalk being a function of proximity or distance between the transmitting signal lead pair 190 and the adjacent signal lead pair 190. However, the crosstalk generated in the connector assemblies, 102 and 104 (FIG. 1) may be cancelled if the leads of one signal lead pair 190 in one of the connector assemblies 102, 104 are inverted or flipped with respect to the adjacent signal lead pair 190 in the other of the connector assemblies 102, 104 as will be described.

Figure 4:
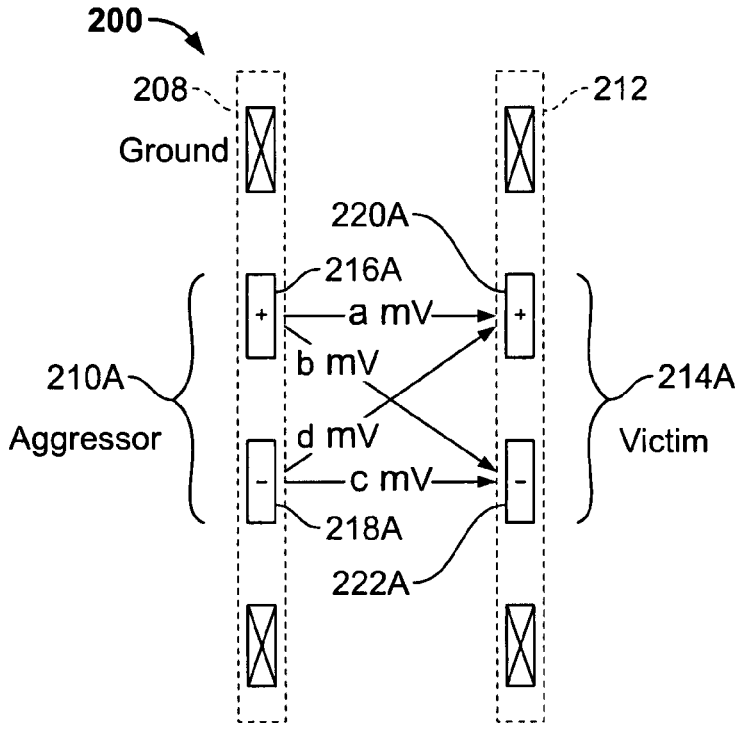
FIG. 4 is a schematic two-pair cross-section of a first connector assembly formed in accordance with an exemplary embodiment of the present invention.
Figure 5:
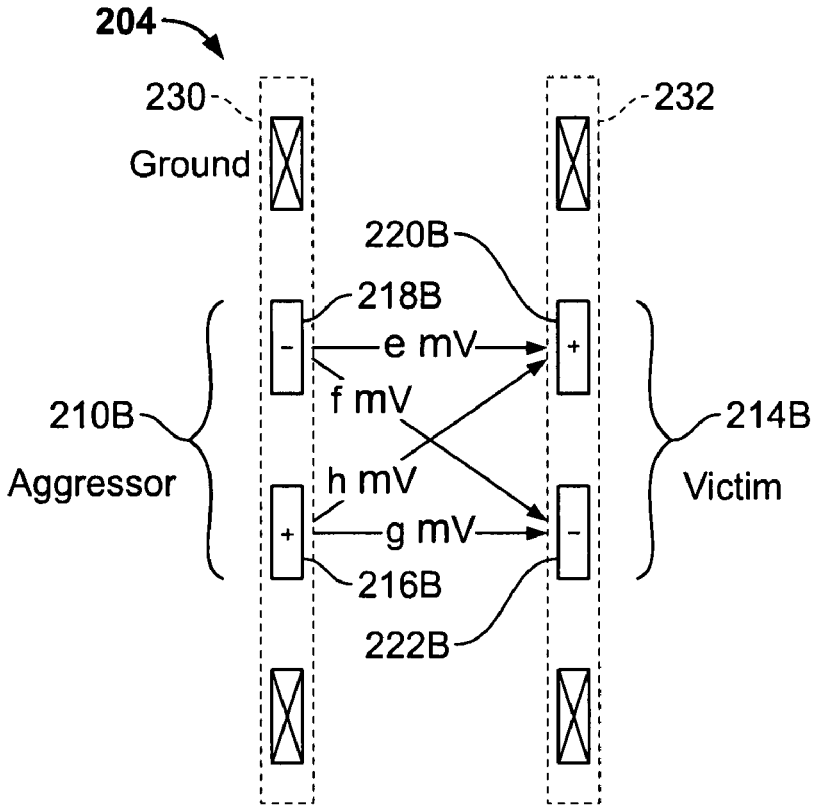
FIG. 5 is a schematic two-pair cross-section of a second connector assembly formed in accordance with an exemplary embodiment of the present invention.
Figure 6:
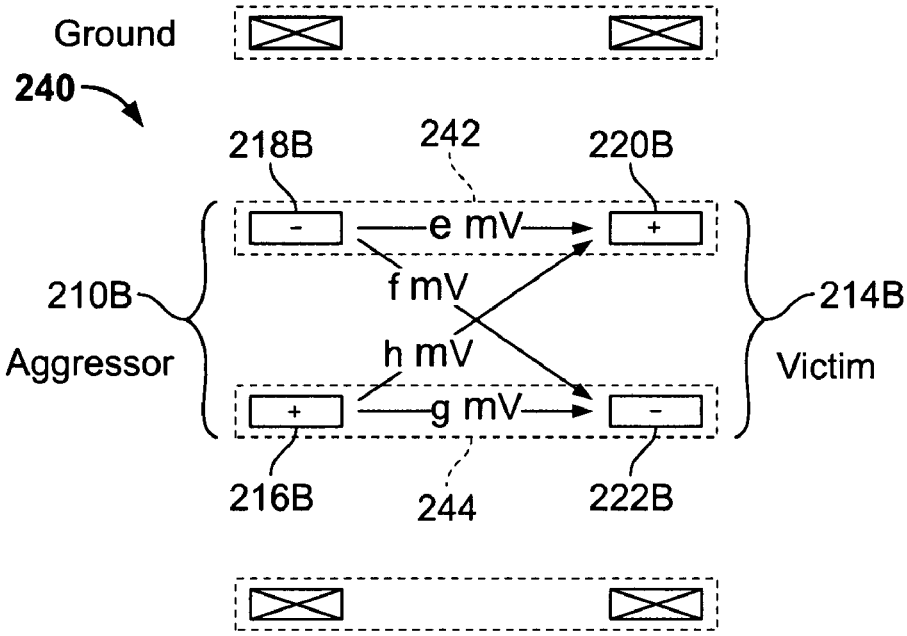
FIG. 6 is a schematic two-pair cross-section of a second connector assembly formed in accordance with an alternative embodiment of the present invention.

FIGS. 4, 5, and 6 illustrate crosstalk cancellation in accordance with the present invention. FIG. 4 illustrates a schematic two-pair cross-section of a mated first connector assembly 200 formed in accordance with an exemplary embodiment of the present invention. FIG. 5 illustrates a schematic two-pair cross-section of a mated second connector assembly 204 that is orthogonal to the first connector assembly 200. Each connector assembly 200 and 204 represents a mated header and receptacle connector pair. The connector assembly 200 includes a chicklet 208 which is shown in phantom lines. The chicklet 208 includes a differential signal pair 210A that by way of example is designated an aggressor signal pair that, at a point in time, is switching or transmitting a signal. An adjacent chicklet 212, also shown in phantom lines, in the connector assembly 200 includes a differential signal pair 214A that is adjacent to the signal pair 210A. By way of example, the signal pair 214A is not switching and is designated a victim signal pair. The aggressor signal pair 210A is generating crosstalk in the victim signal pair 214A as a result of electromagnetic energy coupling between the pairs. The crosstalk in the victim signal pair 214A that propagates in the same direction as the signal in the aggressor signal pair 210A is referred to as far end crosstalk. When the far end crosstalk reaches the receiver (not shown) of the victim signal pair, the crosstalk can erroneously be detected as a switch in the victim signal. For purposes of identification, the lines of the aggressor signal pair 210A are labeled 216A which is designated + and 218A which is designated −. The signal lines of the victim signal pair are labeled 220A which is designated + and 222A which is designated −. In FIG. 4, a, b, c, and d represent crosstalk energy components and may be measured as voltages coupled between signal pairs. Similarly, in FIGS. 5 and 6, e, f, g, and h represent crosstalk energy components and may be measured as voltages coupled between signal pairs. In FIG. 4, the differential crosstalk on the victim signal pair 214A may be expressed as the sum of the energy components (a+d) coupled onto the positive signal line 220A minus the sum of the energy components (b+c) coupled onto the negative signal line 222A, or (a+d)−(b+c). If a and b are positive coupling values, then c and d are negative coupling values since the aggressor signal pair 210A is a differential signal pair.

In the second connector assembly 204 shown in FIG. 5, the aggressor signal pair 210B is located in a chicklet 230. The victim signal pair 214B is located in a chicklet 232. The + and − signal lines 216B and 218B, respectively, of the aggressor signal pair 210B are inverted with respect to the + and − signal lines 220B and 222B, respectively, of the victim signal pair 214B. This relationship is inverse to the relationship of the aggressor and victim signal pairs in the first connector assembly 200. That is, the − aggressor signal line 218B is now in closest proximity to the + victim signal line 220B and the + aggressor signal line 216B is now in closest proximity to the − victim signal line 222B. In the connector assembly 204, the differential crosstalk on the victim signal pair 214B is (e+h), the energy coupled onto 220B minus (f+g), the energy coupled onto 222B, or (e+h)−(f+g). And again, if g and h are positive crosstalk coupling values, then e and f are negative crosstalk coupling values. When the connector assemblies 200 and 204 are orthogonal connector assemblies, the far end crosstalk, or the crosstalk propagated in the same direction as the aggressor signal from the first connector assembly 200 to the second connector assembly 204, is canceled. Cancellation occurs because the signal carried by the aggressor signal pair 210A is the same signal as in the aggressor signal pair 210B, i.e. the coupled voltage amplitudes are the same, but the polarity is reversed in the victim signal pair 214B in the second connector assembly 204. That is, a=−e, b=−f, c=−g, and d=−h, so that the differential crosstalk on the victim signal pair 214B in the second connector assembly 204 is (−a−d)−(−b−c) which cancels the crosstalk from the first connector assembly 200.

FIG. 6 illustrates a schematic two-pair cross-section of a second connector assembly 240 formed in accordance with an alternative embodiment of the present invention. The connector assembly 240 comprises a mated header and receptacle connector that are orthogonal to the connector assembly 200 (FIG. 4). The connector assembly 240 is configured such that the − signal line 218B of the aggressor signal pair 210B and the + signal line 220B of the victim signal pair 214B are located in a chicklet 242. The + signal line 216B of the aggressor signal pair 210B and the − signal line 222B of the victim signal pair 214B are located in a chicklet 244. As with the connector assembly 204 (FIG. 5), the + and − signal lines 216B and 218B, respectively, of the aggressor signal pair 210B and 220B and 222B, respectively, of the victim signal pair 214B are inverted from their relationship to one another in the first connector assembly 200. That is, the − aggressor signal line 218B is now in closest proximity to the + victim signal line 220B and the + aggressor signal line 216B is now in closest proximity to the − victim signal line 222B. In the connector assembly 240, the differential crosstalk on the victim signal pair 214B is (e+h)−(f+g), and again, if g and h are positive crosstalk coupling values, then e and f are negative crosstalk coupling values. As with the connector assembly 204, the far end crosstalk from the first connector assembly 200 is canceled where a=−e, b=−f, c=−g, and d=−h as previously described. If the relative distances between the signal lines 216A, 218A, 220A, and 222A in the connector assembly 200 differ from the corresponding distances between the signal lines 216B, 218B, 220B, and 222B in the connector assembly 240, then the voltage amplitudes of the coupled crosstalk signals such as between a and e, etc. will vary and complete cancellation may not be realized. However, partial crosstalk cancellation is still beneficial.

Figure 7:
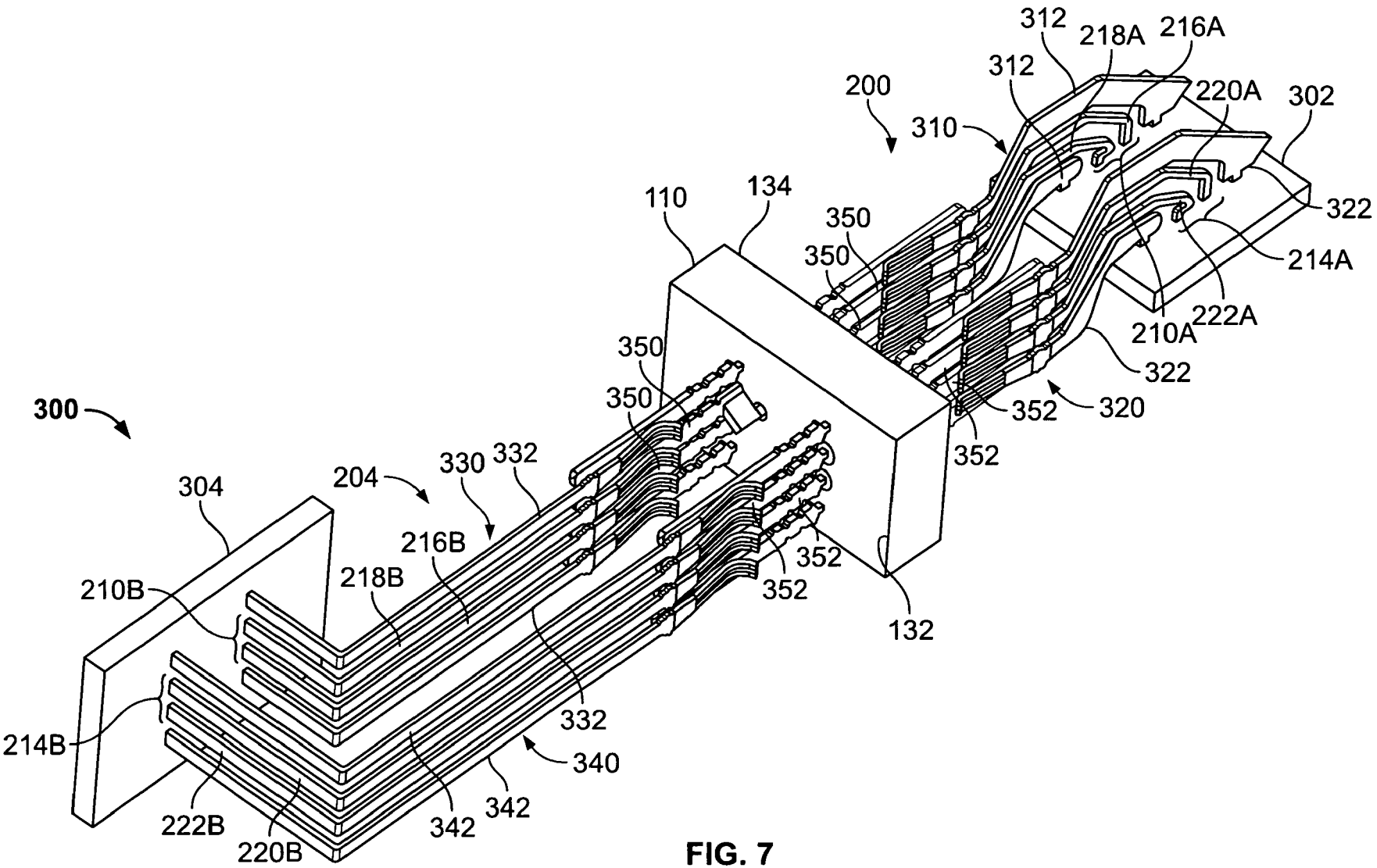
FIG. 7 is a schematic view of an exemplary signal path through a connector system.

FIG. 7 is a schematic view of an exemplary signal path through a connector system 300 that includes the first connector assembly 200 shown in FIG. 4 and the second connector assembly 204, shown in FIG. 5. The first connector assembly 200 is mounted on a circuit board 302. The second connector assembly 204 is mounted on a circuit board 304. The first and second connector assemblies 200 and 204, respectively, are orthogonal assemblies and are connected to one another through the midplane 110. As described below, the first and second connector assemblies 200 and 204 respectively, each include contacts arranged in at least two differential pairs wherein one of the pairs is an aggressor pair 210A, 210B and one of the pairs is a victim pair 214A, 214B, wherein a differential signal carried by the aggressor pair 210A, 210B generates far end crosstalk on the victim pair 214A, 214B. Contacts 350, 352 are arranged such that, when the first and second connector assemblies 200, 204, respectively, are electrically connected to each other, the far end crosstalk on the victim pair 214A in the first connector assembly 200 has a magnitude and a polarity, and the far end crosstalk on the victim pair 214B in the second connector assembly 204 has the same magnitude and an opposite polarity so that the far end crosstalk in the second connector assembly 204 cancels the far end crosstalk in the first connector assembly 200.

The first connector assembly 200 includes a first lead frame 310 that includes ground leads 312 and the differential signal pair 210A with the signal leads 216A and 218A. A second lead frame 320 includes ground leads 322 and the differential signal pair 214A with the signal leads 220A and 222A. The second connector assembly 204 includes a first lead frame 330 that includes ground leads 332 and the differential signal pair 210B with the signal leads 216B and 218B. A second lead frame 340 includes ground leads 342 and the differential signal pair 214B with the signal leads 220B and 222B. The signal leads 216A and 218A are connected through header contacts 350 at the midplane 110 to the signal leads 216B and 218B respectively. Likewise, the signal leads 220A and 222A connect through header contacts 352 at the midplane 110 to the signal leads 220B and 222B respectively. However, the signal leads 216B and 218B are inverted with respect to one another as compared to the signal leads 216A and 218A, while the relationship of the signal leads 220B and 222B with respect to one another as compared to the signal leads 220A and 222A is unchanged. In this manner, far end crosstalk from one differential signal pair to an adjacent differential signal pair in the first connector assembly 200 is canceled in the second connector assembly 204. The inversion of the signal leads 216B and 218B with respect to the signal leads 216A and 218A is accomplished with the header contacts 350 at their connection to the midplane 110 as described below.

Figure 8:
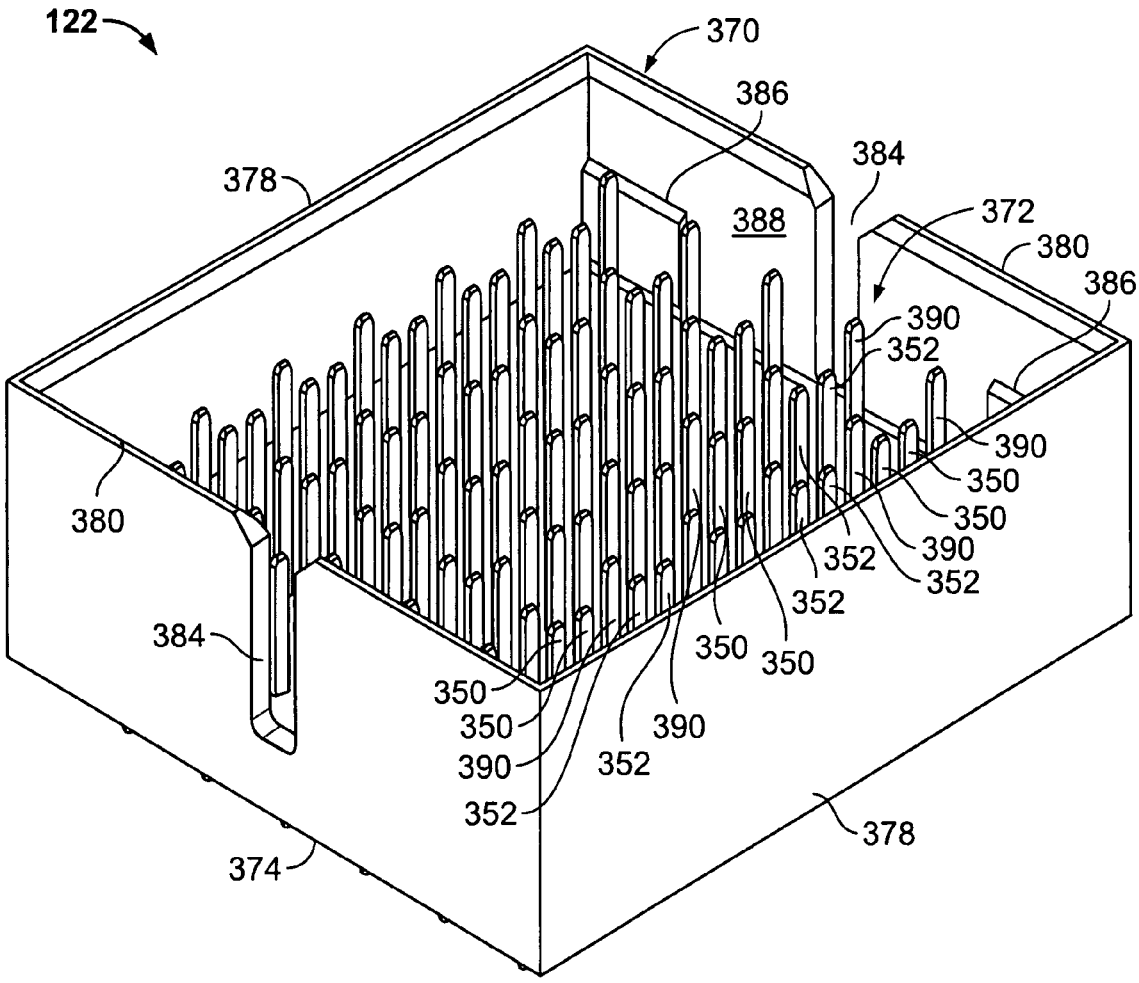
FIG. 8 is a perspective view of a header connector formed in accordance with an exemplary embodiment of the present invention.

FIG. 8 illustrates a perspective view of the header connector 122. The header connector 122 includes a dielectric housing 370 having a mating end 372 that receives the receptacle connector 120 and a mounting end 374 for mounting the header connector 122 to the midplane board 110 (FIG. 7). The housing 370 includes opposite shrouds 378 and opposite shrouds 380 that cooperate to surround the mating end 372. Guide slots 384 are provided on the shrouds 380 that receive the guide ribs 160 on the receptacle connector 120 (FIG. 2) to orient the receptacle connector 120 with respect to the header connector 122. Alignment pads 386 are formed on the interior surfaces 388 of the shrouds 380. The alignment pads 386 are received in the alignment recesses 161 on the receptacle connector 120 to further assure proper orientation of the receptacle connector 120 with respect to the header connector 122.

The header connector 122 holds a plurality of electrical contacts including ground contacts 390 and two configurations of signal contacts 350 and 352. The signal contacts 352 are straight signal contacts. The signal contacts 350 are offset signal contacts that, when used in corresponding pairs on opposite sides of a midplane 110 (FIG. 7), can invert a pair of mating signal leads with respect to one another from one side of the midplane 110 to the other as will be described.

The ground contacts 390 are longer than the signal contacts 350 and 352 so that the ground contacts 390 are the first to mate and last to break when the header connector 122 is mated and separated, respectively, with the receptacle connector 120 (FIG. 2). The contacts 350, 352, and 390 are arranged in rows including pairs of signal contacts 350, 352 and individual ground contacts 390 arranged in an alternating sequence. Within the alternating sequence, the pairs of signal contacts 350, 352 also alternate. For instance, in FIG. 8, the first contact row includes a ground contact 390, a pair of signal contacts 350, a ground contact 390, then a pair of signal contacts 352, etc. The order of the signal contacts 350 and 352 also alternates in adjacent contact rows.

Figure 9:
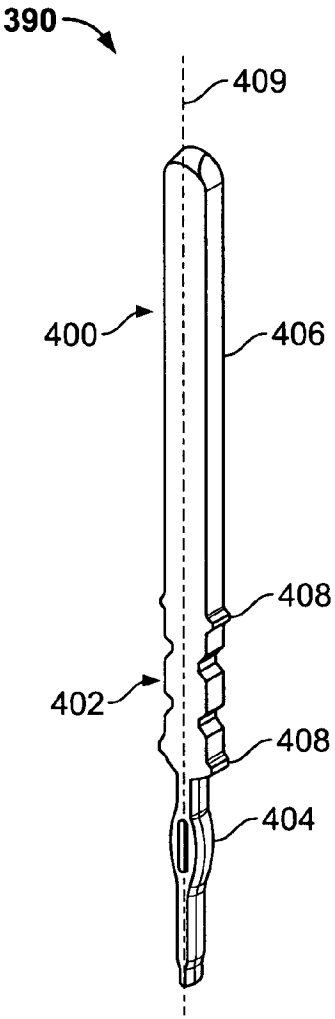
FIG. 9 is a perspective view of an exemplary header connector ground contact.

FIG. 9 illustrates an exemplary ground contact 390 which may be used, for example, in the header connector 122 (shown in FIG. 8). The ground contact 390 includes a mating end 400, a mid-section 402, and a mounting end 404. The mating end 400 includes a blade section 406 that is configured to be matable with a ground contact in a mating receptacle connector 120 (FIG. 1). The mid-section 402 is configured for press fit installation in the housing 370 (FIG. 8). The mid-section 402 includes retention barbs 408 that retain the ground contact 390 in the housing 370. The ground contact 390 is of straight construction wherein the mating end 400, mid-section 402, and mounting end 404 all lie along a common centerline 409. The mounting end 404 extends from the housing 370 and is provided for mounting the header connector 122 on a circuit board, such as the midplane board 110 (FIG. 7) or a panel, or the like. In an exemplary embodiment, the mounting end 404 is a compliant eye of the needle design.

Figure 10:
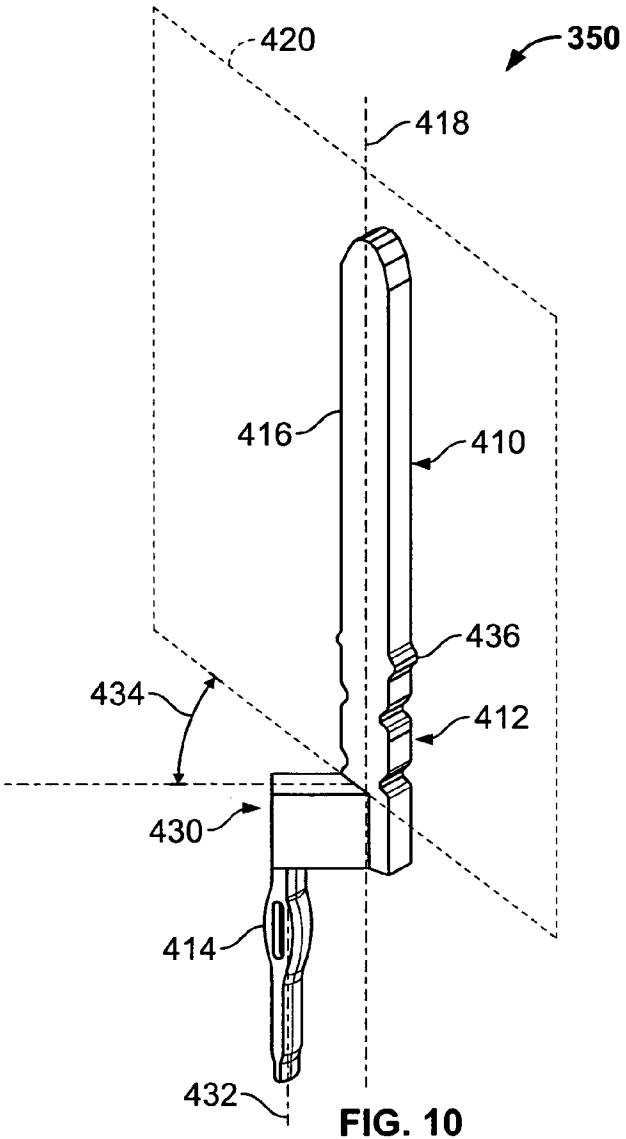
FIG. 10 is a perspective view of an exemplary header connector offset signal contact.

FIG. 10 illustrates a perspective view of the offset signal contact 350 that is configured to invert a differential signal lead pair from one side of the midplane 110 (FIG. 7) to the other when used in a pair of header connectors mated either directly or through a midplane as shown for example in FIG. 7. The offset signal contact 350 includes a mating end 410, a mid-section 412, and a mounting end 414. The mating end 410 includes a blade section 416 that is configured to be matable with a signal contact in a mating receptacle connector 120 (FIG. 1). The blade section 416 and mid-section 412 extend along a longitudinal centerline 418 and lie in a plane 420. A plate 430 extends from the mid-section 412 and the mounting end 414 extends from the plate 430 along a longitudinal centerline 432 such that the mounting end 414 is offset from the mating end 410 and mid-section 412. The plate 430 is formed at an angle 434 with the plane 420 of the blade section 416. In the exemplary embodiment, the angle 434 is about forty-five degrees. The plate 430 shifts the mounting end 414 out of alignment with the mating end 410 of the signal contact 350. The mounting end 414 extends from the housing 370 and is provided for mounting the header connector 122 to a circuit board, such as the midplane board 110 (FIG. 7) or a panel, or the like. In an exemplary embodiment, the mounting end 414 is a compliant eye of the needle design. The mid-section 412 may also include one or more retention barbs 436 to hold the signal contact 350 in the header connector housing 370.

Figure 11:
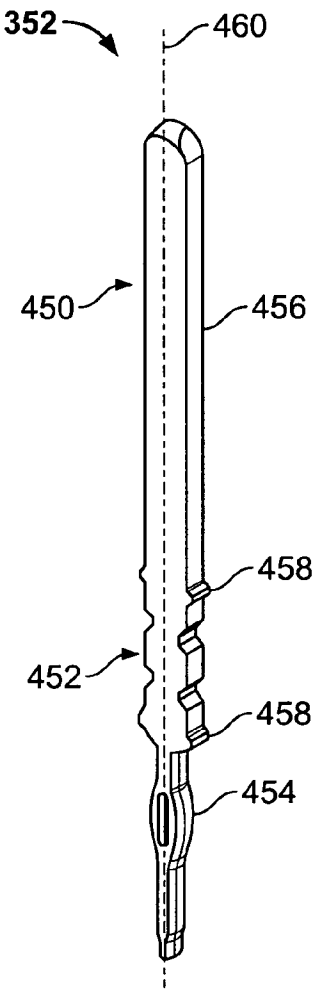
FIG. 11 is a perspective view of an exemplary header connector straight signal contact.

FIG. 11 illustrates an exemplary straight signal contact 352 which may be used, for example, in the header connector 122 (shown in FIG. 8). The straight signal contact 352 includes a mating end 450, a mid-section 452, and a mounting end 454. The mating end 450 includes a blade section 456 that is configured to be matable with a signal contact in a mating receptacle connector 120 (FIG. 1). The mid-section 452 is configured for press fit installation in the housing 370 (FIG. 8). The mid-section 452 includes retention barbs 458 that retain the straight signal contact 352 in the housing 370. The straight signal contact 352 is of straight construction wherein the mating end 450, mid-section 452, and mounting end 454 all lie along a common centerline 460. The mounting end 454 extends from the housing 370 and is provided for mounting the header connector 122 on a circuit board, such as the midplane board 110 (FIG. 7) or a panel, or the like. In an exemplary embodiment, the mounting end 404 is a compliant eye of the needle design. The straight signal contact 352 is similar to the ground contact 390 with the exception that the blade section 406 of the ground contact 390 is longer than the blade section 456 of the straight signal contact 352.

Figure 12:
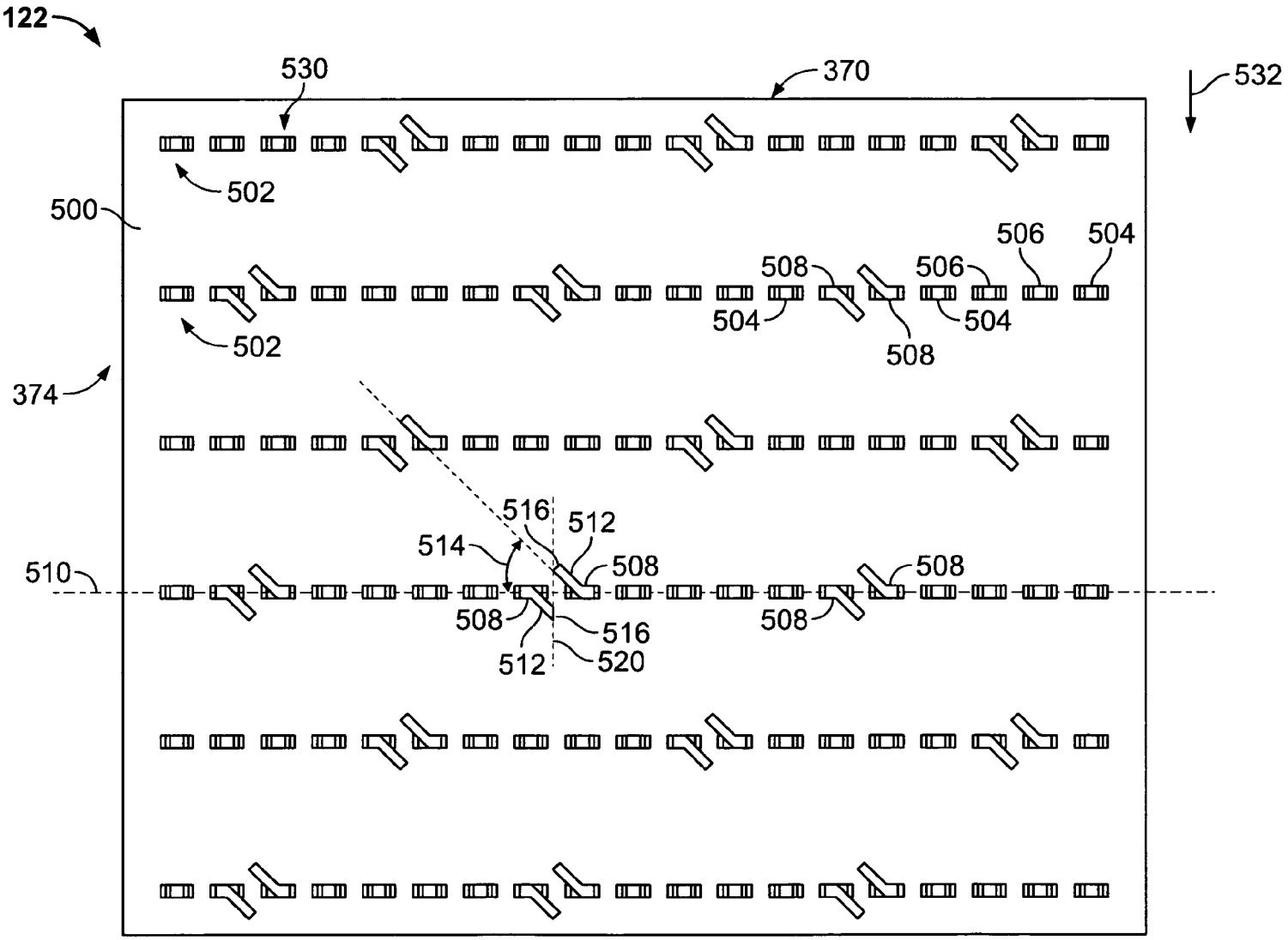
FIG. 12 is a top plan view of the mounting end of the header connector shown in FIG. 8.

FIG. 12 illustrates a bottom plan view of the mounting end 374 of the header connector 122. The header connector housing 370 includes a base 500 having a plurality of contact cavities arranged in rows 502. Each row 502 of contact cavities includes ground contact cavities 504, pairs of straight signal contact cavities 506, and pairs of offset signal contact cavities 508, each of which receives a respective ground contact 390, straight signal contact 352, and offset signal contact 350 (FIG. 8). In each row 502 the contact cavities are formed in an alternating sequence of individual ground contact cavities 504 and pairs of straight signal contact cavities 506 alternated with pairs of offset signal contact cavities 508 as described above with respect to the signal and ground contacts 350, 352 and 390. Each contact cavity row 502 extends along a centerline 510. Each offset contact cavity 508 includes a slot 512 that is sized to receive the plate 430 on the offset signal contact 350. The slots extend at an angle 514 that is substantially the same as the angle 434 and which is about forty-five degrees. Each of the slots 512 within an adjacent pair of offset contact cavities 508 extend in opposite directions from the centerline 510. More specifically, the offset signal contacts 350 are loaded into the connector housing such that the plates 430 of adjacent contacts 350 within a contact pair extend in opposite directions from the contact row centerline 510. Distal ends 516 of each adjacent pair of slots 512 define a line 520 therebetween that is substantially perpendicular to the centerline 510. When the offset signal contacts 350 are loaded into the connector housing 370, the mounting ends 414 of the offset signal contacts 350 extend upward from the housing base 500 and lie in a plane defined by the line 520 and perpendicular to the base 500.

Contact cavity columns 530 extend across the housing base 500 in the direction of the arrow 532 which is substantially perpendicular to the contact rows centerline 510. Each contact cavity column 530 receives only signal contacts 350, 352 or ground contacts 390 (FIG. 8). The signal and ground contacts 350, 352, and 390 are configured to be received in vias in the midplane board 110 (FIG. 7). The signal contacts 350 and 352 are received in through vias to electrically connect with signal contacts in a header connector on the other side of the midplane board 110. The ground contacts 390 may or may not share vias in the midplane board 110. In some embodiments, the ground contacts 390 may be configured to electrically engage at least one ground plane in the midplane board 110. The ground planes provide continuity between the ground contacts 390 in the header connector 122 from one side 132 of the midplane board 110 to the ground contacts in a header connector such as the header connector 126 (FIG. 1) on other side 134 of the midplane board 110.

Figure 13:
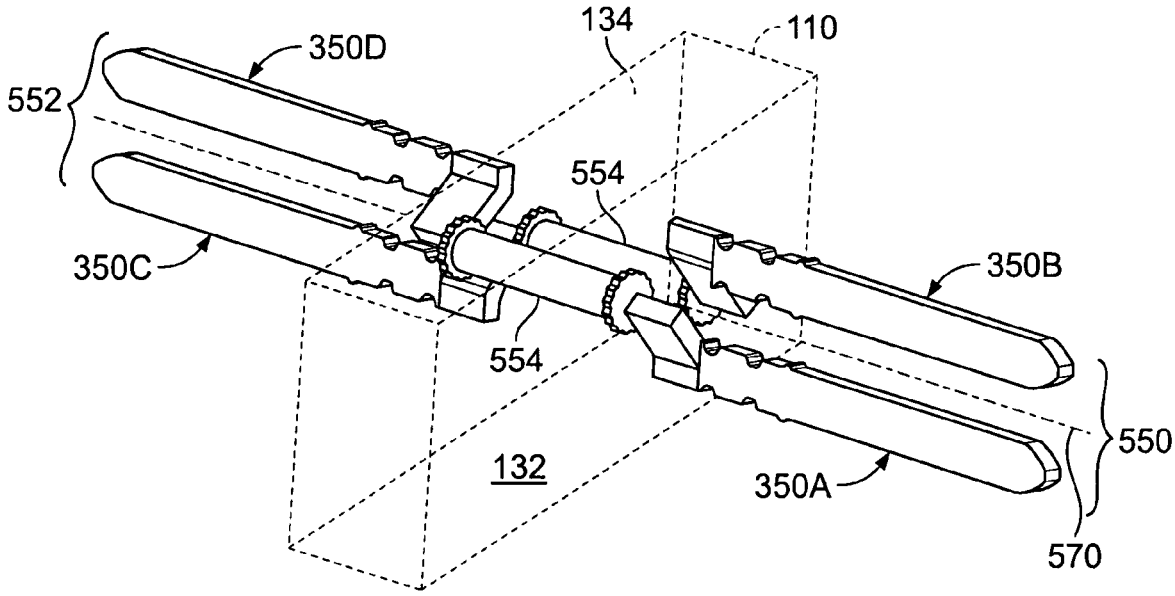
FIG. 13 is a perspective view of a mounted pair of offset signal contacts.

FIG. 13 is a perspective view of two mated pair 550 and 552 of offset signal contacts. A contact pair 550 is electrically connected to the contact pair 552 through vias 554 in the midplane 110 and carries differential signals. The contact pair 550 includes offset contacts 350A and 350B and is located on one side 132 of the midplane 110. The contact pair 552 includes offset contacts 350C and 350D and is located on the other side 134 of the midplane 110. The contacts 350A, 350B, 350C, and 350D of each contact pair 550 and 552 are arranged about a common axis 570. The contacts 350A, 350B, 350C, and 350D are oriented such that the contact 350A of the contact pair 550 is electrically connected to the contact 350D of the contact pair 552 and the contact 350B is electrically connected to the contact 350C of the contact pair 552. Thus, the contact 350C of the contact pair 552 is offset one hundred eighty degrees about the axis 570 with respect to the contact 350B to which it is electrically connected in the contact pair 550. Similarly, the contact 350D of the contact pair 552 is offset one hundred eighty degrees about the axis 570 with respect to the contact 350A to which it is electrically connected in the contact pair 550. In this manner, the contact pair 550 on one side 132 of the midplane 110 is effectively inverted or flipped with respect to the mating contact pair 552 on the other side 134 of the midplane 110. More specifically, the relative position of one contact pair, such as the contact pair 550 having offset contacts 350A, 350B is inverted with respect to an adjacent contact an adjacent contact pair (not shown) having straight contacts such as the contact 352 (FIG. 11). And further, in a connector such as the connector 122 (FIG. 8) that has alternating pairs of straight signal contacts 352 (FIG. 11) and offset signal contacts 350 (FIG. 10), any far end crosstalk from the signals carried in an adjacent contact pair (see FIG. 7) generated in the connector 122 on one side 132 of the midplane 110 is canceled when the signal passes through the midplane 110 and through a mating connector such as the connector 126 (FIG. 1) on the other side 134 of the midplane 110 that also includes alternating pairs of straight signal contacts 352 and offset signal contacts 350 correspondingly arranged with contacts 352 and 350 in the connector 122.

Figure 14:
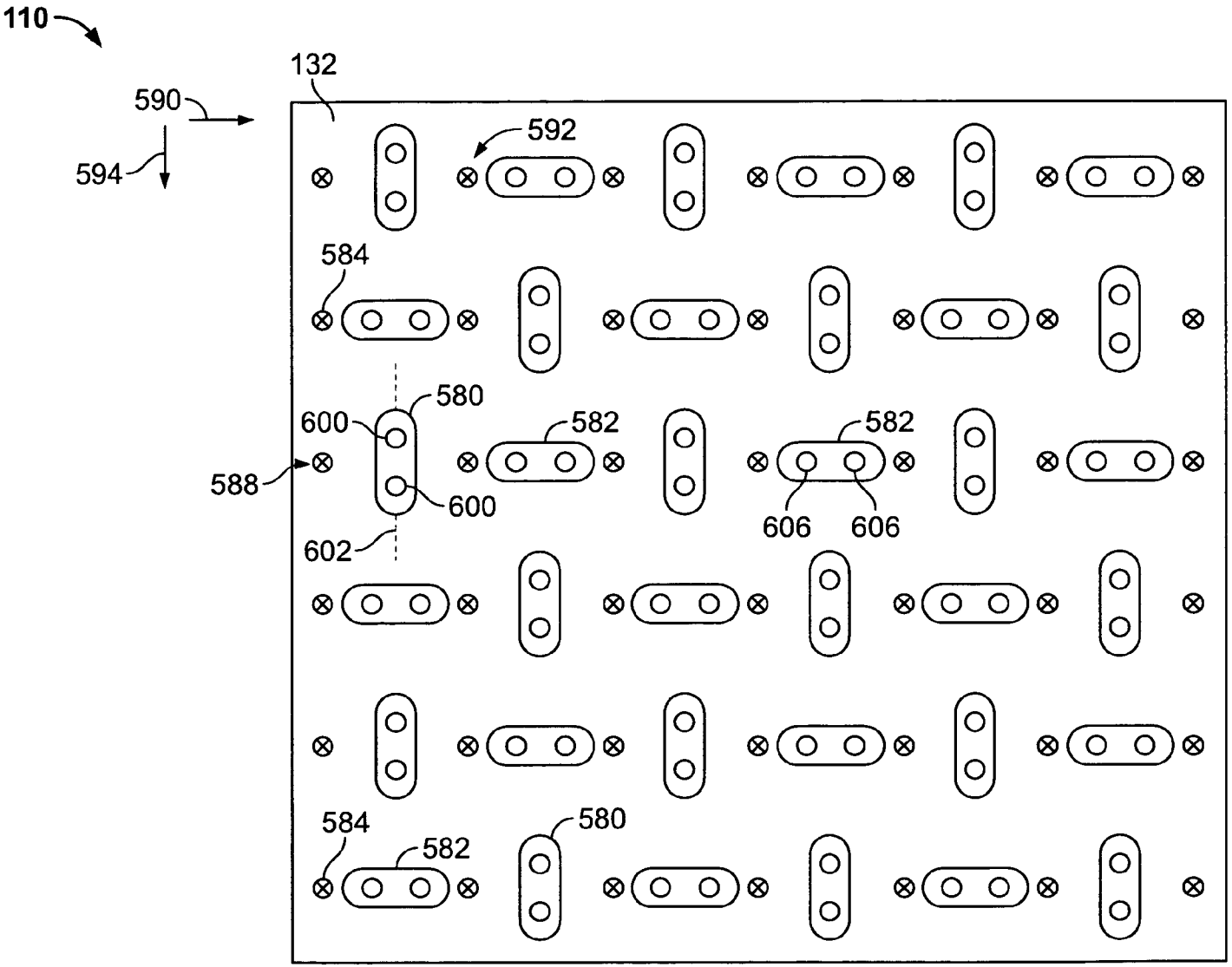
FIG. 14 is a top plan view of the via pattern of a midplane board.

FIG. 14 is a top plan view of the via pattern on one side 132 of the midplane board 110. The via pattern includes pairs of signal vias 580, 582 and individual ground vias 584. The via pattern includes vias arranged in rows 588 that extend in the direction of the arrow 590 and columns 592 that extend in the direction of the arrow 594 which is substantially perpendicular to the direction of the arrow 590. The signal vias 580 are configured to receive the offset signal contacts 350 (FIG. 10). The signal vias 582 are configured to receive the straight signal contacts 352 (FIG. 7). Each pair of signal vias 580 includes individual vias 600 that are arranged along a centerline 602 that is substantially perpendicular to the direction 590 of the rows 588. That is, the signal via pairs 580 are rotated ninety degrees from the orientation of the signal via pairs 582. By contrast, individual vias 606 in each signal via pair 582 are aligned in the direction 590 of the rows 588.

In each row 588, ground vias 584 and pairs of signal vias 580 and 582 are arranged in an alternating sequence. Within the sequence, the signal via pairs 580 alternate with signal via pairs 582 to yield a sequence such as: ground via 584, signal via pair 580, ground via 584, signal via pair 582, ground via 584, etc. In addition, the signal via pairs 580 and 582 are offset from one another in adjacent rows 588. The signal vias 600 and 606 are through vias that receive a signal contacts 350, 352 (FIG. 7) at each end to directly interconnect signal contacts 350, 352 on each side of the midplane 110. The ground vias 584 in some embodiments are through vias that directly interconnect ground contacts 390 on each side of the midplane 110. In other embodiments, one or more ground vias 584 may electrically engage one or more ground planes in the midplane 110. Each via column 592 includes vias that are either all ground vias 584 or all alternating pairs of signal vias 580, 582.

The embodiments thus described provide a connector that cancels far end crosstalk when used in a system of two mated pairs of orthogonal connectors. The connector is suitable for use in orthogonal systems designed to carry differential signals. The connector includes alternating offset signal contact pairs and straight signal contact pairs. Corresponding offset signal pairs on opposite sides of a midplane or panel cooperate to invert or flip the orientation of a differential signal pair to cancel the crosstalk coupled from an adjacent differential signal pair as the signals are transmitted through the connector.

While the invention has been described in terms of various specific embodiments, those skilled in the art will recognize that the invention can be practiced with modification within the spirit and scope of the claims.

What is claimed is:

1. An electrical connector comprising:

a housing having a mating face and a mounting face, the housing holding signal contacts and ground contacts arranged in rows, each of said signal contacts and ground contacts including a mating end extending from said mating face of said housing and a mounting end extending from said mounting face of said housing, wherein said signal contacts are arranged in alternating pairs of straight signal contacts and offset signal contacts, structure of said pair of straight signal contacts are different from said pair of offset signal contacts, and wherein for each said row, said mounting ends of said ground contacts and said straight signal contacts are arranged along a centerline of said row and said mounting ends of said offset signal contacts in each pair of offset signal contacts are offset on opposite sides of said centerline.

2. The connector of claim 1, wherein said mounting end of each said offset signal contact is out of alignment with said mating end.

3. The connector of claim 1, wherein said mounting ends of each said pair of offset signal contacts are aligned perpendicularly to said centerline of said row.

4. The connector of claim 1, wherein said offset signal contact includes a mid-section formed with said mating end, and wherein said mating end and said mid-section lie in a plane, and wherein said offset signal contact includes a plate that extends from said mid-section at an angle of about forty-five degrees with respect to said plane.

5. The connector of claim 1, wherein said housing includes a base having signal contact cavities, at least one of said signal contact cavities including a slot and at least one of said offset signal contacts including a plate that is received in said slot to orient said offset signal contact in said signal contact cavity.

6. The connector of claim 1, wherein said signal contacts and said ground contacts are arranged in a pattern of pairs of signal contacts and individual ground contacts arranged in an alternating sequence and wherein said pairs of straight signal contacts alternate with said pairs of offset signal contacts within said sequence.

7. The connector of claim 1, wherein columns of contacts in said housing include one of all signal contacts and all ground contacts.

8. An orthogonal connector assembly including a pair of connectors configured to be electrically connected to one another from opposite sides of a circuit board, said electrical connector assembly comprising:

first and second connector housings, each having a mating face and a mounting face, said mounting faces being configured to be electrically connected to one another from opposite sides of the circuit board in line with one another along a longitudinal axis, and wherein said first and second connector housings are angularly offset ninety degrees about said longitudinal axis with respect to one another; and signal and ground contacts held in said connector housings and arranged in rows, each said signal contact and ground contact including a mating end and a mounting end, and wherein said signal contacts include pairs of straight signal contacts and offset signal contacts, and wherein mated pairs of said offset signal contacts on opposite sides of the circuit board are arranged about a common axis and wherein said mated pairs are rotated one hundred eighty degrees with respect to one another about said axis.

9. The orthogonal connector assembly of claim 8, wherein said offset signal contact includes a mid-section formed with said mating end, and wherein said mating end and said mid-section lie in a plane, and wherein said offset signal contact includes a plate that extends from said mid-section at an angle of about forty-five degrees with respect to said plane.

10. The orthogonal connector assembly of claim 8, wherein said mounting end of each said signal contact in said first connector housing and said corresponding mounting end of said signal contact in said second connector housing are received in opposite ends of the same via in the circuit board.

11. The orthogonal connector assembly of claim 8, wherein said offset signal contacts include an offset that moves said mounting end out of alignment with said mating end of said offset signal contacts.

12. The orthogonal connector assembly of claim 8, wherein said ground contacts are configured to electrically engage a ground plane in the circuit board that provides electrical continuity between ground contacts in said first and second connector housings.

13. The orthogonal connector of claim 8, wherein each of said housings includes a base having signal contact cavities, at least one of said signal contact cavities including a slot and at least one of said offset signal contacts including a plate that is received in said slot to orient said offset signal contact in said signal contact cavity.

14. The orthogonal connector of claim 8, wherein said signal contacts and said ground contacts in each of said housings are arranged in a pattern of pairs of signal contacts and individual ground contacts arranged in an alternating sequence and wherein said pairs of straight signal contacts alternate with said pairs of offset signal contacts within said sequence.

15. The orthogonal connector assembly of claim 8 further comprising a mating connector joined to each said first and second connector housing, each said mating connector including a contact lead frame having signal leads arranged in differential pairs.

* * * * *